US005152605A

United States Patent [19]

Yamada et al.

[11] Patent Number: 5,152,605

[45] Date of Patent: Oct. 6, 1992

[54] APPARATUS FOR MAKING COOLED CONCRETE

[75] Inventors: Ryuzo Yamada, Ikeda; Masayuki Takeuchi, Tokushima, both of Japan

[73] Assignees: Ushio Co., Ltd.; I. P. Co., Ltd., both of Tokushima, Japan

[21] Appl. No.: 643,945

[22] Filed: Jan. 22, 1991

[51] Int. Cl.[5] ..... B01F 15/06

[52] U.S. Cl. ..... 366/148; 366/7; 366/144; 62/375; 134/108; 198/822

[58] Field of Search ..... 366/1, 7, 22–25, 366/144, 148; 62/64, 375, 430, 434, 435; 198/822; 134/107, 108

[56] References Cited

U.S. PATENT DOCUMENTS

| | | | |
|---|---|---|---|
| 1,545,759 | 7/1925 | Guignard et al. | 198/822 |
| 2,491,194 | 12/1949 | McShea | 366/24 |
| 2,595,631 | 5/1952 | Bertsch | 366/7 |
| 2,648,206 | 8/1953 | Carr | 366/7 |
| 2,727,734 | 12/1955 | Vincent | 366/22 |
| 2,758,445 | 8/1956 | Saxe | 366/144 |
| 3,036,440 | 5/1962 | Feinman | 62/64 |
| 3,410,765 | 11/1968 | Bodine | 366/144 |

FOREIGN PATENT DOCUMENTS

| | | | |
|---|---|---|---|
| 198307 | 8/1989 | Japan | 366/7 |

*Primary Examiner*—Harvey C. Hornsby
*Assistant Examiner*—Mark Spisich
*Attorney, Agent, or Firm*—Wenderoth, Lind & Ponack

[57] ABSTRACT

The apparatus for making cooled concrete of this invention produces cooled fresh concrete by cooling the aggregate (or gravel). The aggregate is cooled by immersion in a cooling water bath accommodated in a cooling water tank. The cooling water in the tank is cooled by a heat exchanger, which in turn is cooled by a forced cooling device. The aggregate is immersed into the cooling water bath by a supply and ejection apparatus, which also removes the cooled aggregate from the cooling water bath. The cooled aggregate is supplied to a cement mixer where it is mixed to become cooled fresh concrete.

5 Claims, 4 Drawing Sheets

APPARATUS FOR MAKING COOLED CONCRETE

BACKGROUND OF THE INVENTION

This invention relates to apparatus for making cooled pourable concrete. It is desirable that the temperature of fresh concrete be low. In particular, the characteristics of concrete made in summer with daytime temperatures above 77° F. (25° C.) are improved by cooling. Specifically, hot weather concrete has the following drawbacks:

(1) reduction in slump (slump is the height lost in a mound of concrete poured into a truncated conical form when the form is removed according to JIS A 1101 specifications; the softer the concrete, the greater the slump.)

(2) cracking, and (3) reduction in strength.

Water evaporation is responsible for slump reduction. For example, it is reported that 18 cm. slump concrete has a 6 cm. reduction in slump when agitated in a truck agitator for about one hour with an 86° F. (30° C.) temperature when mixed. When slump is reduced, pouring becomes difficult. It becomes necessary to add cement paste and remix the concrete. Further, fresh concrete has the characteristic that even when the amount of added water is adjusted to be the same, the slump is still reduced as temperature is increased.

Cracking during hardening is caused by heat generation within the interior of the concrete. The hydration reaction that occurs when concrete hardens is an exothermic reaction. When heat is generated in the interior, a temperature differential is created between the interior and outer surfaces of the concrete. Expansion of the heated interior and contraction of the cooled outer surfaces generates cracks.

The cracking of concrete has detrimental effects on every application. Particularly, in the case of structures such as dams, bridge supports under the ocean, and walls of nuclear reactors, cracks can be a fatal flaw.

Further, hot weather concrete has reduced strength when hardened.

Drawbacks such as these can be eliminated by cooling the fresh concrete. Apparatus which cool the water added to the concrete have been developed for cooling fresh concrete. However, the temperature of the concrete cannot be cooled significantly by cooling the added water. This is because the amount of water added to the concrete is only 4% to 6% of the entire mixture.

Apparatus which cool the cement that is added to fresh concrete have also been developed. In these apparatus, the cement is forcibly cooled by blowing liquefied nitrogen gas into it. These apparatus have the feature that the cement can be cooled without adding water, but they have the drawback of extremely high running costs. The reason for this is the large consumption of expensive liquid nitrogen. Therefore, these apparatus can only be used for special purpose concrete.

Of all the materials added to concrete, aggregate or gravel is the largest component by weight. Therefore, the most effective way to reduce the temperature of fresh concrete is to cool the aggregate. Apparatus for cooling aggregate have been developed to reduce this idea to practice.

An apparatus which utilizes the heat of vaporization of aggregate surface water has been developed as (Japanese Patent disclosure 188317/1982). In this apparatus, aggregate is loaded into an airtight tank, air is evacuated from the tank forcibly vaporizing the water, and the aggregate is cooled by the vaporization of the water. This apparatus has the drawback of high equipment cost incurred by the requirement for a large pressure tank and a high volume vacuum pump. It also has the drawback that the aggregate cannot be cooled in a continuous fashion.

In addition, cooling apparatus which discharge liquefied nitrogen gas onto the aggregate have been developed (Japanese Patent disclosures 156045/1988, 26407/1989, and 26408/1989). Apparatus such as these have the feature that cooling can be achieved without adding water to the aggregate. Further, they have the feature that the aggregate can be cooled to a low temperature. However, like apparatus which cool the cement with liquefied nitrogen gas, these apparatus also have have the disadvantage of high running costs, and therefore can be used only for special applications.

SUMMARY OF THE INVENTION

This invention was developed to resolve previous problems including those mentioned above. Accordingly, it is a primary object of this invention to provide an apparatus for making cooled concrete which can cool fresh concrete to low temperatures at a low running cost.

In one preferred embodiment of the apparatus for making cooled concrete of the present invention, a cooling water bath is provided for cooling aggregate immersed in the cooling water bath. The cooling water bath is part of a cooling water circuit including a circulation pump, and a heat exchanger for cooling. Cooling water supplied to the heat exchanger is cooled by a forced cooling device. Aggregate cooled in the cooling water bath is mixed in a cement mixer to produce cooled fresh concrete.

BRIEF DESCRIPTION OF THE DRAWINGS

FIG. 2 is a cross-sectional view of one embodiment of the cooling water through;

DETAILED DESCRIPTION OF THE INVENTION

The following describes an embodiment of the present invention based on illustrations.

However, the following embodiment is only intended as a specific example illustrative of the technology involved in the apparatus of the present invention, and consequently, the apparatus of the present invention is in no way restricted to the materials, form, construction, or placement of structural parts described in the following. It is therefore to be understood that, in the scope of the appended claims, the invention may be practiced other than specifically described.

Figure 1:
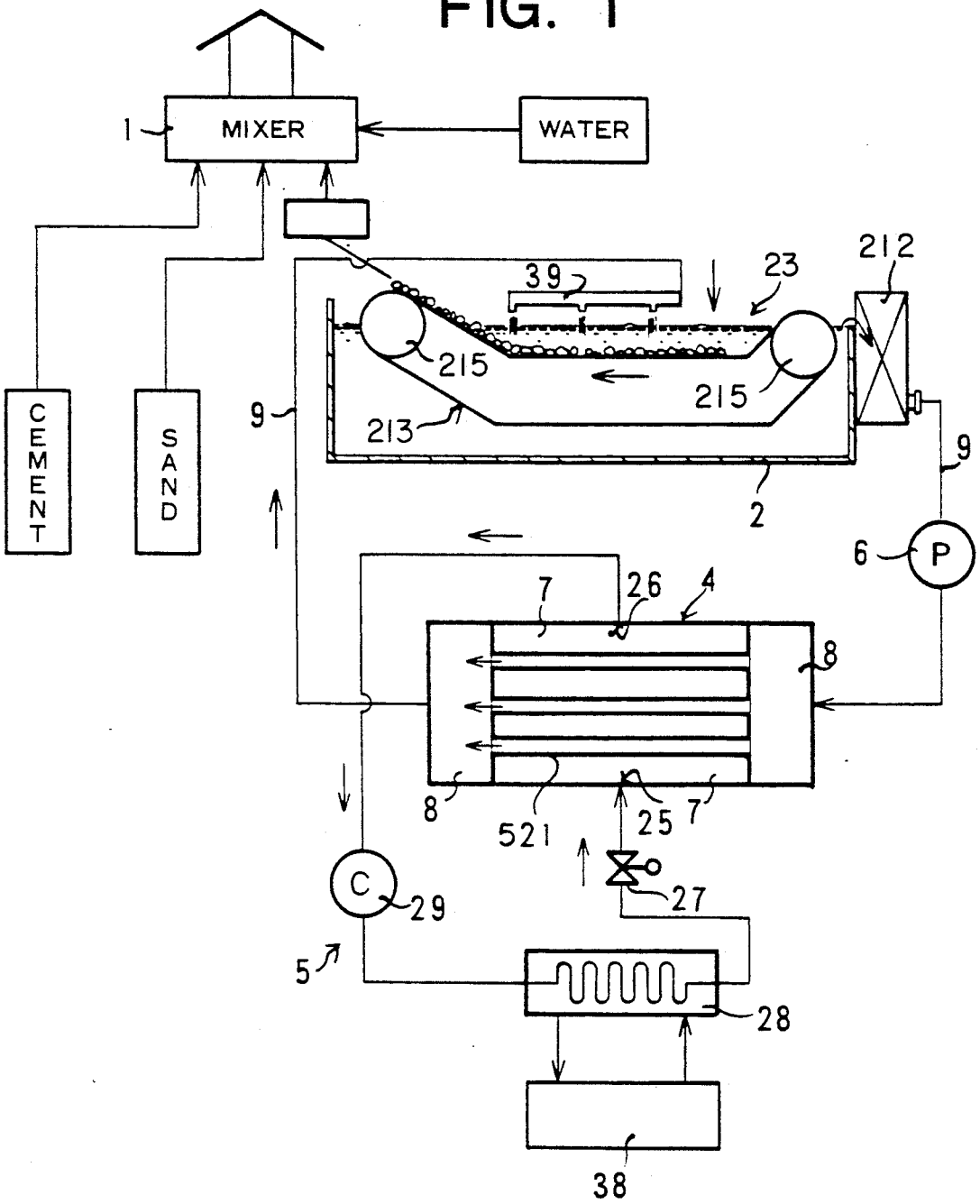
FIG. 1 is a diagrammatic cross-sectional view of a preferred embodiment of the apparatus for making cooled concrete of this invention.

Turning to FIG. 1, the apparatus for making cooled concrete comprises a cement mixer 1 for mixing aggregate, cement, sand, and water; a cooling water bath 2 for cooling aggregate before supplying it to the cement mixer 1; a supply and ejection means 23 for conveying aggregate into and out of the cooling water bath 2; a heat exchanger 4 for cooling the water for the cooling water bath 2; a forced cooling device 5 to provide refrigerant to the heat exchanger 4; and a circulation pump 6 to circulate cooling water along circulation piping 9 from the heat exchanger 4 to the cooling water bath 2.

Any cement mixer that can mix the cooled aggregate, cement, sand, and water can be used for the cement mixer 1.

The cooling water bath 2 is a long narrow trough, thereby having an open top. The cooling water bath 2 cools aggregate which is conveyed through the bath. The size of the cooling water bath 2 is determined by the amount of aggregate cooling per unit time. For the case of cooling a 250 ton processing load of aggregate, a 2 to 3.5 m wide, 0.6 to 1.5 m high, and 5 to 15 m long cooling water bath 2 is desirable.

Aggregate cooling time depends on the size of the aggregate. More time is required to cool through to the interior of a large aggregate piece than a small aggregate piece. Consequently, it is necessary to lengthen the immersion time for aggregate having large individual pieces. Aggregate immersion time can be increased by increasing the overall length of the cooling water bath 2. Therefore, a cooling water bath 2 for aggregate having large individual pieces is relatively long. For example, a cooling water bath 2 for cooling 250 ton unit time processing loads of 5 to 150 mm diameter aggregate is 10 to 15 m long, while one for cooling 5 to 40 mm diameter aggregate is 5 to 8 m long.

Figure 2:
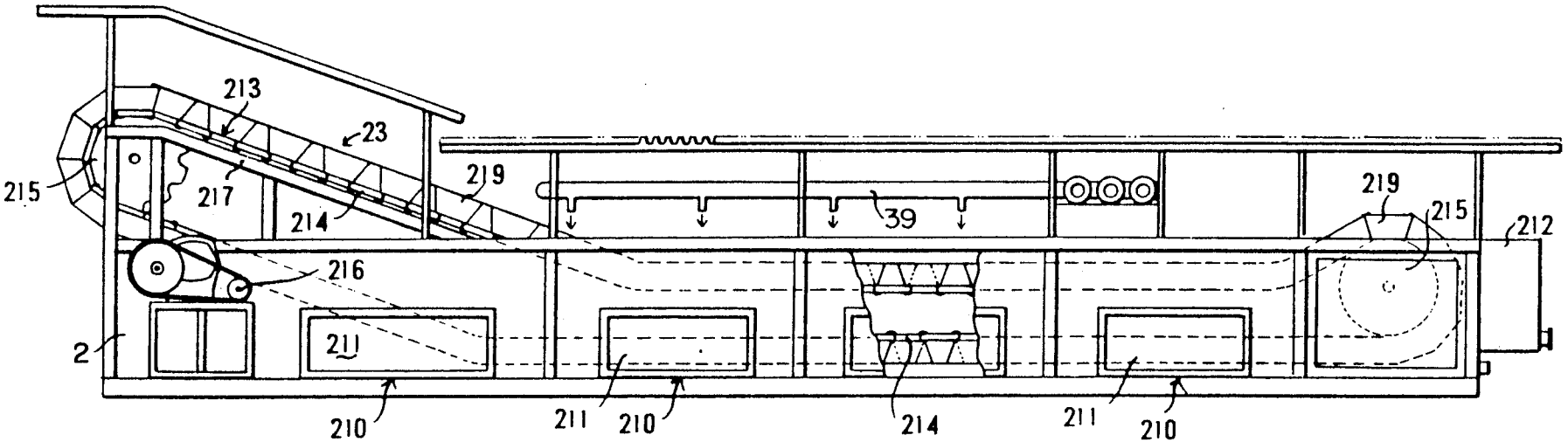

Use of the cooling water bath 2 results in sand and dirt accumulation in the bottom of the bath. This is because sand and dirt on the surface of aggregate pieces are washed off by the cooling water and sink to the bottom of the bath. As shown in FIG. 2, cleaning windows 210 are provided in the bottom portion of the side walls of the cooling water bath 2 for removing accumulated sand, and dirt. The cleaning windows 210 are closed for a water tight seal with removable panels 211. Accumulated sand and dirt can be cleaned from the bottom of the bath by taking off the removable panels 211.

As shown in FIG. 2, a cooling water outlet is open at the right end wall of the cooling water bath 2. A filter 212 is mounted at the cooling water outlet. Cooling water containing sand and dirt is passed through the filter 212 to supply the heat exchanger 4 with clean water.

Figure 3:
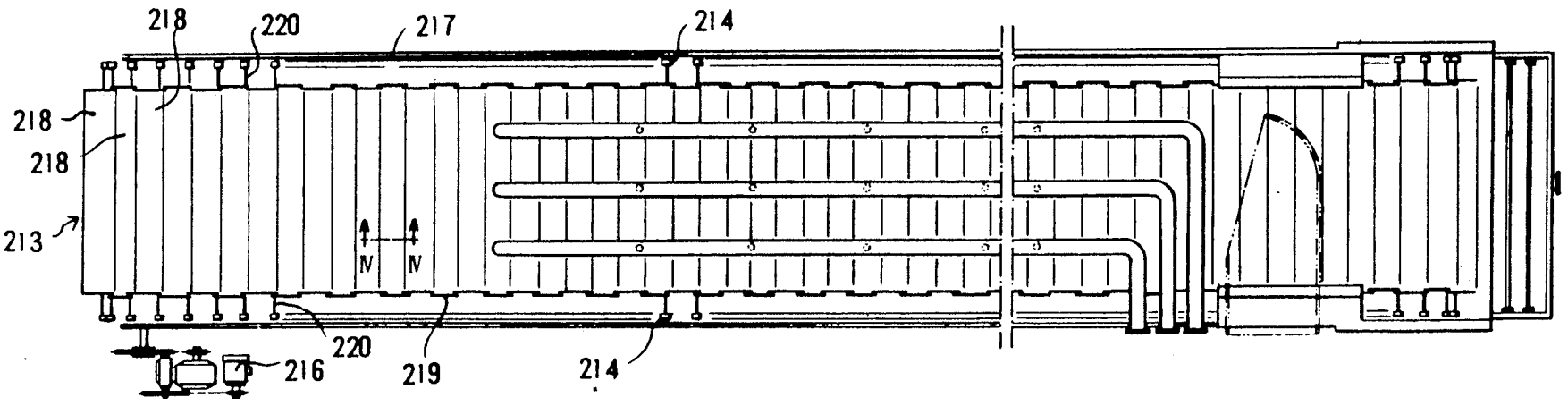
FIG. 3 is a plan view of the cooling water through shown in FIG. 2.

The apparatus shown in FIG. 2 and FIG. 3 uses a conveyor belt assembly for the supply and ejection means 23. While transporting the aggregate, the conveyor belt cools it in a continuous fashion. Specifically, aggregate loaded on the conveyor belt is transported through the cooling water bath 2, immersing the aggregate into the cooling water. As shown in FIG. 2, the conveyor belt 213 cools aggregate by transporting it from right to left across the cooling water bath 2.

The supply and ejection means 23, which is a conveyor belt assembly, comprises the conveyor belt 213, chains 214 connected to both sides of the conveyor belt 213, sprockets 215 to drive the chains 214, a motor 216 to provide rotational power to a sprocket, and chain guides 217.

The conveyor belt 213 is constructed from narrow width loading plates 218 which are connected in a manner allowing pivoting of the plates relative to one another. Vertical side plates 219 are fixed to each end of each loading plate 218. The vertical side plates 219 prevent aggregate loaded on the loading plates 218 from falling off the sides of the conveyor belt. The vertical side plates 219 are wider at the top than at the bottom so as to have an inverted trapezoidal shape. Adjacent inverted trapezoidal vertical side plates 219 are overlapped a prescribed width. As shown in FIG. 3, the overlapping vertical side plates 219 are joined with the inside surface of one plate displaced slightly from the outside surfaces of adjacent plates, to allow the overlapped portions to slide freely.

Holes are provided through both ends of the shorter parallel edge (base) of each inverted trapezoidal vertical side plate 219, for connection to the chains 214 through pins 220. The pins 220 pass through these holes in the vertical side plates 219 to connect the loading plates 218 with the chains 214 in a planar fashion. Because the loading plates 218 are connected to the chains 214 through pins 220 at both the forward and trailing edges relative to the direction of motion, they maintain a horizontal configuration even when loaded thereby transporting aggregate without rotating.

Figure 4:
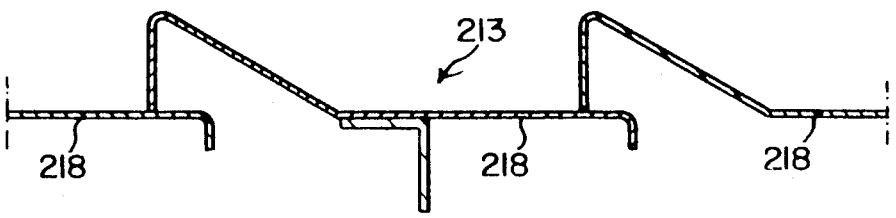
FIG. 4 is a cross-sectional side view of loading plates of the supply and ejection means taken along line IV—IV of FIG. 3.

Turning to FIG. 4, the cross-sectional shape of the loading plates 218 is shown. Loading plates 218 with this shape have their forward edges relative to the direction of motion bent to form triangular protrusions. A conveyor belt with loading plates 218 of this shape has the advantage that aggregate can be transported without slippage forward or backward on the belt.

The chains 214 are connected to both ends of the loading plates 218, and move the conveyor belt formed from all the connected loading plates 218. The chains shown in FIG. 1 and FIG. 2 move the loading plates loaded with aggregate from right to left.

Chain guides 217 are mounted under the upper portion of the chains 214 where the aggregate is carried. The path taken by the chains 214 carrying aggregate is determined by the chain guides 217. The chains 214 move the conveyor belt carrying aggregate into the cooling water of the cooling water bath 2. Consequently, as shown in FIG. 2, the path of chain movement must be such that the center portion, where aggregate is cooled, is positioned lower than both end portions. In other words, the upper portion of the conveyor belt 213 gradually descends from the right sprocket 215, moves horizontally through the cooling water at the center portion, then rises in an upward slope towards the left sprocket 215. Therefore, the chain guide 217 shown in FIG. 2 extends horizontally in the center portion and slopes upward at both sides.

The left sprocket 215, engaged with the chains 214, is connected to the motor 216 through a reduction device, and is rotationally driven by the motor 216.

The supply and ejection means 23 with this configuration transports aggregate supplied at the right end of the conveyor belt towards the left. Aggregate is cooled by immersion in the cooling water during transit, then is ejected at the left end.

Prior to delivery to the cement mixer, it is desirable for water to be separated from the aggregate which is cooled by immersion in cooling water during transport.

Water is removed from the aggregate at the ejection end of the supply and ejection means, or by an additional water separator installed between the supply and ejection means and the cement mixer.

Separation of water from aggregate at the ejection end of the supply and ejection means can be accomplished by vibrating the conveyor belt of the supply and ejection means.

On the other hand, a device which removes water from the aggregate by centrifugal force, a device which removes water by shaking the aggregate on top of a mesh surface, or other such devices can be used as an additional water separator installed between the supply and ejection means and the cement mixer.

The heat exchanger 4 cools the cooling water by causing heat energy to be exchanged between the refrigerant and the cooling water. In this application of the heat exchanger 4, sand and dirt mixed with the cooling water are circulated through the heat exchanger. Therefore, a heat exchanger construction that allows dirty cooling water passageways to be easily cleaned is required. If dirt and sand accumulate in the cooling water passageways, the efficiency of heat exchange will be reduced.

Figure 5:
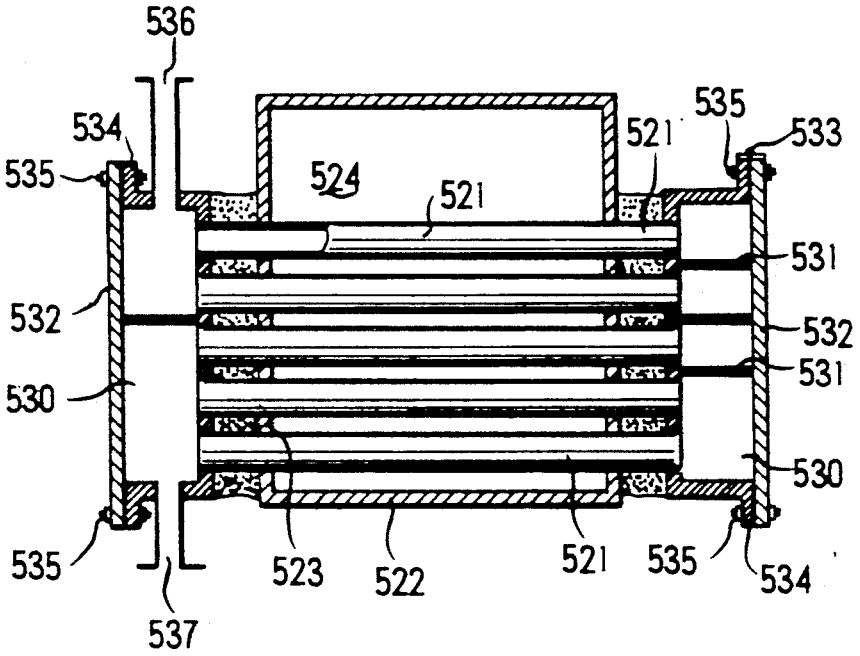
FIG. 5 is a cross-sectional view of one embodiment of the heat exchanger for cooling shown in the apparatus of FIG. 1.
Figure 6:
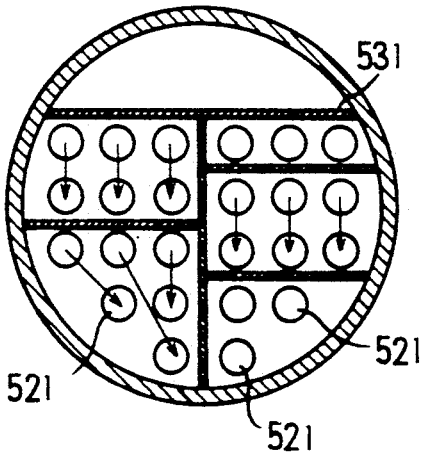
FIG. 6 and FIG. 7 are cross-sectional views of end pieces of the heat exchanger for cooling shown in FIG. 5.
Figure 7:
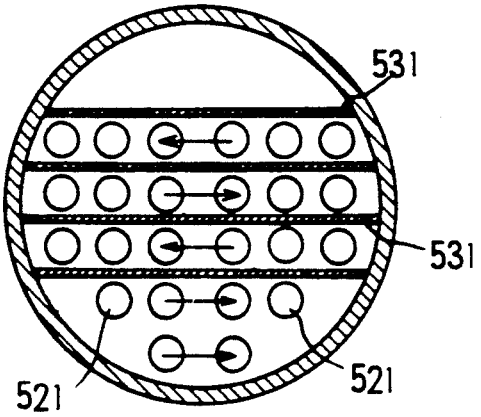

Turning to FIG. 5, FIG. 6, and FIG. 7, the heat exchanger 4 with cooling water passageways 521 that can be easily cleaned, is shown. The cooling water passageways 521 protrude through both end walls 523 of the cylindrical casing 522 in an airtight fashion, and flow chamber connect the ends of the plurality of cooling water passageways 521.

The end walls 523 provide an enclosed airtight refrigerant chamber 524 within which refrigerant evaporates for heat removal. As shown in FIG. 1, the refrigerant chamber 524 has a refrigerant inlet opening 25 and outlet opening 26. The refrigerant inlet opening 25 communicates with a condenser 28 through an expansion valve 27, and the outlet opening 26 is connected to the intake side of a compressor 29.

The cooling water passageways 521 are made slightly longer than the overall length of the cylindrical casing 522, and pass through, as well as protrude from, both casing end walls 523 in an airtight fashion. It is desirable to use a corrosion resistant metal such as titanium alloy or stainless steel for the cooling water passageways 521.

Outside the casing walls 523 around the cooling water passageways 521 a calking is applied which is strongly adhesive to metal, solidifies to a hard state, is resistant to cold, and expands little. Further, it is possible to cover the entire outer surface of the casing walls 523 with calking.

It is also possible to use materials for the cooling water passageways 521 that can be easily welded to the casing walls 523 such as iron, copper, brass, and aluminum in place of stainless steel or titanium.

The ends of the cooling water passageways 521 are connected with the flow chambers 532 at both ends of the cylindrical casing 522 in a water-tight fashion. The flow chambers 530 cause cooling water or other fluid to flow through the plurality of the cooling water passageways 521 in series or in parallel, or through a series connection of several of the cooling water passageways 521 connected in parallel.

FIG. 6 and FIG. 7 show the flow chambers 530 on the left and right sides, respectively, of the cooling water passageways 521 of FIG. 5. These flow chambers 530 are provided with dividers 531 that connect a parallel combination of three cooling water passageways in series.

The dividers 531 extend to the inside wall of each access door 532. In this manner, the heat exchanger 4 with dividers 531 has the feature that a plurality of cooling water passageways 521 can be connected in series to lengthen the cooling water flow path through the heat exchanger.

The access doors 532 at the outer sides of each flow chamber 530, above the ends of the cooling water passageways 521, are closed in a water tight fashion and allow for easy cleaning of the cooling water passageways 521. As shown in FIG. 5, the upper edges of the access doors 532 are attached to the upper edges of the flow chambers 530 through hinges 533. Flanges 534 are provided around the perimeter of the flow chambers 530 to allow a watertight seal between the access doors 532 and the flow chambers 530. The flanges 534 and the access doors 532 are held together with nuts 534. Each access door 532 is opened by removing the nuts 535 and lifting the bottom of the door. With the door opened, cleaning tools can be inserted to clean the insides of the cooling water passageways 521.

A cooling water inlet 536 and cooling water outlet 537 are connected to one of the flow chambers 30.

The forced cooling device 5 that supplies refrigerant to the heat exchanger 4 comprises a compressor 29, a condenser 28, a radiative cooler 38 for cooling the condenser 28, and an expansion valve 27. Vaporized refrigerant from the heat exchanger 4 is fed to the intake of the compressor 29, where it is compressed and sent to the condenser 28. The condenser 28 cools the compressed refrigerant to a liquid.

The radiative cooler 38 cools the condenser 28 to liquefy the refrigerant. A cooling tower or an air-cooled heat exchanger may be used as the radiative cooler 38.

The expansion valve 27 adjusts the amount of refrigerant supplied to the heat exchanger 4. Refrigerant introduced into the heat exchanger 4 through the expansion valve 27 expands and vaporizes within the heat exchanger 4, and cools the cooling water passageways 21 by absorbing heat of vaporization from the surroundings.

The circulation pump 6 supplies cooling water, for cooling the aggregate, to the cooling water bath 2 from the heat exchanger 4. Water distribution pipes 39 are connected to the outlet side of the circulation pump 6. The water distribution pipes 39 are mounted above the cooling water bath 2, and cool the aggregate by spraying water into the cooling water bath 2.

The water distribution pipes 39 do not necessarily have to be mounted above the cooling water bath 2. Although it is not illustrated, they may be connected to the cooling water bath 2, to circulate cooling water through the cooling water bath 2.

In the apparatus shown in FIG. 1, aggregate is cooled by immersion in the cooling water bath accommodated within the cooling water bath 2. However, this invention is not restricted to the aggregate cooling system illustrated in FIG. 1. Although it is not illustrated, it is also possible to cool the aggregate by spraying it with cooling water rather than immersing it in the cooling water.

The apparatus for making cooled concrete shown in FIG. 1 makes cooled fresh concrete under the following operation.

Uncooled aggregate is supplied to the cooling water bath 2 by the supply and ejection means 23. Aggregate put into the cooling water bath 2 is cooled by contact with the cooling water. In the cooling water bath 2, aggregate is cooled by immersion in a cooling water, by spraying with cooling water, or by immersion in a cooling water after spraying. The aggregate is removed from the cooling water bath 2 by the supply and ejection means 23, and supplied to the cement mixer 1.

Cooling water is supplied to the cooling water bath 2 by the circulation pump 6. Cooling water is circulated by the circulation pump 6 as follows: cooling water bath 2→cooling compartment 8 of the heat exchanger 4→circulation pump 6→cooling water bath 2. The circulating cooling water is cooled by the heat exchanger 4, and then is sprayed on the aggregate to cool it.

Liquefied refrigerant is supplied to the refrigerant compartment 7 of the heat exchanger 4 from the forced cooling device 5. The liquefied refrigerant is vaporized in the refrigerant compartment 7 of the heat exchanger 4, and cools the cooling water by the heat of vaporization.

With this apparatus, the temperature of the freshly mixed concrete can be regulated by adjusting the cooling temperature of the aggregate. For example, when used in an environment with an outside temperature above 77° F. (25° C.), cooling the aggregate to 46° F. (8° C.) allows the temperature of the freshly mixed concrete to be significantly reduced to approximately 63° F. (17° C.) to 64° F. (18° C.).

Table 1 through Table 3 show the resulting mixed concrete temperatures corresponding to constituent aggregate and cement temperatures. Table 1 indicates results from the use of the apparatus for making cooled concrete of this invention, Table 2 indicates results with no cooling of the concrete constituents, and Table 3 indicates results from adding ice instead of water.

As indicated in Table 1, the apparatus of this invention can make fresh concrete with a temperature of 63° F. (17° C.) by cooling the aggregate to 46° F. (8° C.). The reason that the apparatus of this invention can cool fresh concrete to a very low temperature is because the quantity of heat in the aggregate, which has a very large heat capacity, can be significantly reduced. As indicated in Table 3, even by using ice instead of water, the mixed temperature can only be cooled to 72° F. (22° C.). The reason that the fresh concrete temperature is not significantly reduced by adding ice, which has a large heat of fusion, is because the quantity added is small.

This apparatus therefore has the feature that fresh concrete can easily be cooled to a low temperature, and the concrete can be hardened in a very good environment.

Further, a particularly noteworthy feature of this apparatus for making cooled concrete is despite its ability to cool fresh concrete to a low temperature, its running cost is extremely low. The reasons for this are that the cooling water which contacts the aggregate for forced cooling is circulated and reused, and that the cooling water directly contacts the aggregate to cool it.

It is desirable to reduce the temperature of the circulating reused cooling water to as close to 32° F. (0° C.) as possible at the supply point to the cooling water bath. This is because low temperature cooling water can cool the aggregate to a low temperature in a short time interval. However, since water below 32° F. (0° C.) will freeze and not circulate, cooling water above 32° F. (0° C.), and preferably between 34° F. (1° C.) and 41° F. (5° C.) is circulated. The cooling water, which cools the aggregate, absorbs heat energy from the aggregate, and the temperature of the cooling water rises slightly. For example, cooling water which cools aggregate to 48° F. (9° C.) rises in temperature to 41° F. (5° C.) to 45° F. (7° C.). The temperature of cooling water after cooling the aggregate is lower than that of water at room temperature. Therefore after slight cooling in the heat exchanger, the temperature of the cooling water is low enough to allow it to cool aggregate again.

Consequently, the cooling efficiency of this apparatus is much greater than for systems which cool down new water after discarding water which has cooled the aggregate. For this reason, in the case where the forced cooling device is driven by electric power, aggregate can be cooled down efficiently with little power consumption. The apparatus of this invention has the features that electric power use is efficient, and unlike prior apparatus that used expensive liquid nitrogen, this apparatus can be used economically for many applications.

TABLE 1

| CONCRETE MATERIALS | AMOUNT (kg/m³) | TEMPERATURE AT MIXING (°C.) | SPECIFIC HEAT (Kcal/kg °C.) | HEAT CAPACITY (Kcal/m³) |
|---|---|---|---|---|
| COARSE AGGREGATE | 1,590 | 8 | 0.2 | 2,544 |
| SAND | 518 | 30 | 0.2 | 3,108 |
| CEMENT | 200 | 60 | 0.27 | 3,240 |
| SURFACE WATER | 25 | 30 | 1.0 | 750 |
| PURE MIXED WATER | 80 | 2 | 1.0 | 160 |
| TOTAL | 2.413 | 17 | 0.241 | 9,802 |

TABLE 2

| CONCRETE MATERIALS | AMOUNT (kg/m³) | SPECIFIC HEAT (Kcal/kg °C.) | BEGINING TEMPERATURE (°C.) | HEAT CAPACITY (Kcal/m³) |
|---|---|---|---|---|
| COARSE AGGREGATE | 1,590 | 0.2 | 30 | 9,540 |
| SAND | 518 | 0.2 | 30 | 3,108 |
| CEMENT | 200 | 0.27 | 60 | 3.240 |
| WATER | 105 | 1.0 | 27 | 2,835 |
| TOTAL | 2.413 | 0.241 | 32 | 18,723 |

TABLE 3

| CONCRETE MATERIALS | AMOUNT (kg/m³) | BEGINING TEMPERATURE (°C.) | TEMPERATURE AT MIXED (°C.) | SPECIFIC HEAT (Kcal/kg °C.) | HEAT CAPACITY (Kcal/m³) |
|---|---|---|---|---|---|
| COARSE AGGREGATE | 1.590 | 30 | 30 | 0.2 | 9.540 |
| SAND | 518 | 30 | 30 | 0.2 | 3.108 |
| CEMENT | 200 | 60 | 60 | 0.27 | 3.240 |
| SURFACE WATER | 25 | 30 | 30 | 1.0 | 750 |
| ICE | 52 | −5 | 0 | 0.5(ICE)→ 1.0(WATER) | −4,290 |
| PURE MIXED WATER | 28 | 27 | 7 | 1.0 | 196 |
| TOTAL | 2.413 | | 22 | 0.241 | 12.544 |

We claim:

1. Apparatus for making cooled concrete, said apparatus comprising:

a cement mixer;

cooling water bath means for providing a bath of cooling water, said cooling water bath means including a trough having a bottom wall, end walls extending upright from said bottom wall at opposite ends of the trough, respectively, and side walls extending upright from said bottom wall and between said end walls at opposite sides of the trough, respectively, said end walls and said side walls having upper free terminal edges such that the trough is open at the top thereof and whereby the trough is capable of accommodating a bath of cooling water up to a level below the top thereof;

supply and ejection means, extending into said trough below said upper free terminal edges and in operative association with said cement mixer, for immersing a supply of aggregate in a bath of cooling water accommodated by said trough and for directing the aggregate once so immersed to said cement mixer;

circulation piping forming a circuit with said trough and along which circuit cooling water is circulatable;

a heat exchanger operatively connected in said circuit, said heat exchanger defining a water cooling compartment communicating with said circulation piping, and a refrigerant compartment in a heat-exchange relation with said water cooling compartment, whereby cooling water passing through the water cooling compartment undergoes heat exchange with refrigerant passing through said refrigerant compartment;

a circulation pump operatively connected to said circulation piping, said pump being operable to force cooling water to circulate through said piping between said trough and the water cooling compartment of said heat exchanger; and forced cooling means for forcing liquified refrigerant through the refrigerant compartment of said heat exchanger.

2. Apparatus for making cooled concrete as claimed in claim 1, wherein said supply and ejection means comprises a conveyor including a conveyor belt having a run extending into said trough below said upper free terminal edges.

3. Apparatus for making cooled concrete as claimed in claim 2, wherein said belt includes a plurality of hinged sections.

4. Apparatus for making cooled concrete as claimed in claim 3, wherein each of said sections includes a bottom loading plate and side plates extend vertically from the bottom loading plate at opposite sides thereof, respectively.

5. Apparatus for making cooled concrete as claimed in claim 1, wherein said heat exchanger has a casing including end walls, and said water cooling compartment includes a plurality of pipes passing through said casing and extending through the end walls of said casing in a water-tight fashion, and flow chambers communicating with said pipes at ends thereof.

* * * * *